US005981089A

United States Patent [19]

Imai et al.

[11] Patent Number: 5,981,089

[45] Date of Patent: Nov. 9, 1999

[54] FERROUS ALLOY WITH FE-AL DIFFUSION LAYER AND METHOD OF MAKING THE SAME

[75] Inventors: Junji Imai, Amagasaki; Tadashi Hamada, Sakai; Shuji Yamada, Ashiya; Hiroshi Yamada, Kasugai; Fumio Iwane, Nagoya, all of Japan

[73] Assignee: Matsushita Electric Works, Ltd., Osaka, Japan

[21] Appl. No.: 08/650,520

[22] Filed: May 20, 1996

[30] Foreign Application Priority Data

May 19, 1995 [JP] Japan ..... 7-121810

[51] Int. Cl.[6] ..... B32B 15/01

[52] U.S. Cl. ..... 428/668; 29/196.2

[58] Field of Search ..... 428/615, 650, 428/652, 653, 681, 682, 683, 685, 686; 29/196.2

[56] References Cited

U.S. PATENT DOCUMENTS

| | | | |
|---|---|---|---|
| 3,640,755 | 2/1972 | Barth | 117/71 M |
| 3,762,885 | 10/1973 | Speirs et al. | 29/196.2 |
| 4,141,760 | 2/1979 | Baldi | 148/31.5 |
| 4,535,034 | 8/1985 | Zaizen et al. | 428/653 |
| 4,655,852 | 4/1987 | Rallis | 148/6.11 |
| 4,891,274 | 1/1990 | Higuchi et al. | 428/653 |
| 4,931,421 | 6/1990 | Shibata | 502/439 |
| 5,017,544 | 5/1991 | Ikegami et al. | 502/439 |

FOREIGN PATENT DOCUMENTS

| | | |
|---|---|---|
| 4250995 | 9/1992 | Japan . |
| 5283149 | 10/1993 | Japan . |
| 992321 | 5/1965 | United Kingdom . |
| 1278085 | 6/1972 | United Kingdom . |

OTHER PUBLICATIONS

Sasaki Masahiro et al., "Influence of the Diffusion Coated Layer of A1 . . . ", J. Surface Finishing Society of Japan (1995), vol. 46 (Abstract), pp. 162–169, no month 1995.

Oki S. et al., "Formation of Alloy Phases by Reaction–Diffusion . . . ", J. Japan Institute of Metals (1994), vol. 58, (Abstract), pp. 966–972, Aug. 1994.

European Search Report, Aug. 19, 1996.

Japanese Patent Office, *Patent Abstracts Of Japan*, 1992, p. 1, Publication number: 04250995 A (English).

Japanese Patent Office, *Patent Abstracts Of Japan*, 1993, p. 1, Publication number: 05283149 A (English).

*Primary Examiner*—Deborah Jones
*Assistant Examiner*—Darlene David
*Attorney, Agent, or Firm*—Burns, Doane, Swecker & Swecker, LLP

[57] ABSTRACT

A ferrous alloy is formed with a Fe—Cr stainless steel having a Vickers hardness of 400 or more as a substrate and a Fe—Al diffusion layer having a thickness of 2 to 50 μm. The diffusion layer contains at least 90 vol % of an intermetallic compound of Al and Fe relative to a total volume of the diffusion layer. The Al content included within a depth of at least 2 μm of the diffusion layer is 35 to 65% by weight based upon total weight of a region of the diffusion layer ranging up to the thickness of at least 2 μm. It is preferred to use as the substrate a precipitation-hardening stainless steel comprising 66 to 81.9 wt % of Fe, 15 to 20 wt % of Cr, 3 to 13 wt % of Ni, and one element selected from 3 to 6 wt % of Cu, 0.5 to 2 wt % of Al, and 0.01 to 0.2 wt % of a total of C and N, or a high carbon stainless steel comprising 73 to 89.9 wt % of Fe, 10 to 19 wt % of Cr, 0.1 to 1.2 wt % of C, and less than 3 wt % of Ni. The ferrous alloy may be used for sliding parts such as gears or bearings, and blades of electric shavers or hair clippers.

15 Claims, 5 Drawing Sheets

FERROUS ALLOY WITH FE-AL DIFFUSION LAYER AND METHOD OF MAKING THE SAME

BACKGROUND ART

1. Field of the Invention

The present invention relates to a ferrous alloy formed with an Fe—Cr stainless steel as a substrate and an Fe—Al diffusion layer of improved hardness, which may be used for sliding parts such as gears and bearings or blades of electric shavers or hair clippers, and a method of making the ferrous alloy.

2. Disclosure of the Prior Art

In the past, carbon tool steels, high carbon stainless steels, and precipitation-hardening stainless steels have been used for sliding parts such as gears and bearings or cutting tools. Those steels exhibit excellent mechanical toughness and shockproof, although, the surface hardness and wear resistance of the steels are not always enough to provide the sliding parts or cutting tools having an extended service life. To improve this problem, it is proposed to use ceramic materials such as aluminum oxide ($Al_2O_3$) or zirconium oxide ($ZrO_2$) of excellent hardness and wear resistance. However, there is another problem that the mechanical toughness of the ceramic materials is much lower than that of the steels. In addition, it is not easy to machine the ceramic materials to various shapes of the sliding parts or cutting tools. Therefore, it is desired to develop a material having improved hardness and wear resistance, while keeping the mechanical strength and toughness of the steels.

For example, Japanese Patent Early Publication [KOKAI] No. 4-250995 teaches a blade material for electric shavers and a method of making the same. The blade material comprises a substrate such as a high hardness and nonmagnetic stainless steel, Fe—Mn alloy or Be—Cu alloy, an intermetallic compound layer of Al and metal elements contained in the substrate, e.g., Ni and Fe, and an $Al_2O_3$ layer on the intermetallic compound layer. The blade material can be made by the steps of cladding Ni and Al foils to the substrate such that the Ni foil is positioned between the substrate and Al foil, heating the cladded substrate in vacuum or oxidation atmosphere to form an intermetallic compound layer of NiAl and/or $Ni_3Al$ and the $Al_2O_3$ layer. When the heat-treatment is performed in vacuum, the cladded substrate is heated at a temperature of 400° C. to 650° C. for 1 to 20 minutes. When the heat-treatment is performed in the oxidation atmosphere, the cladded substrate is heated at a temperature of 600° C. to 1000° C. for 5 to 20 hours. However, since the diffusion rate of Ni atoms into the substrate is much slower than that of Al atoms into the substrate, and also Ni atoms prevent the diffusion of Al atoms into the substrate, there is a problem that the adhesion between the substrate and intermetallic compound layer is not enough.

UK Patent No. 1278085 teaches an aluminum diffusion-coated steel having sulphidation resisting properties in an atmosphere of high temperature and pressure. The coated steel comprises a steel having a surface layer formed by an aluminum diffusion-coating method. The method is characterized by a heat-treatment at a temperature of 800 to 950° C. The surface layer consists of aluminum alloy, and has a thickness not exceeding 300 $\mu$m. The Al content of the surface region of the surface layer is less than 30 wt %. For example, the substrate is an alloy steel containing carbon not exceeding 0.5 wt % and at least one element selected from Mo in the amount of 0.1 to 1.2 wt %, Cr not exceeding 10 wt % and Ni not exceeding 4.5 wt %. For the aluminum diffusion-coating method, a powder pack method, gas method, ceramic adsorption method or hot-dip and diffusing method is applicable. However, since the Al content of the surface layer is less than 30 wt %, it is difficult to form hard Al—Fe intermetallic compounds such as $Al_{13}Fe$, $Al_{13}Fe_4$ or $Al_5Fe_2$ in the surface layer. As a result, the surface layer would be not sufficient to provide high hardness and wear resistance.

SUMMARY OF THE INVENTION

To improve the surface hardness and wear resistance of a steel, the present invention provides a ferrous alloy comprising an Fe—Cr stainless steel as a substrate and an Fe—Al diffusion layer on the substrate, and a method of making the same. The stainless steel has a Vickers hardness of 400 or more. The diffusion layer is characterized in that:

(1) a thickness of the diffusion layer is in the range of 2 to 50 $\mu$m;

(2) the diffusion layer contains at least 90 vol % of an intermetallic compound of Al and Fe relative to a total volume of the diffusion layer;

(3) Al content included within a depth of at least 2 $\mu$m of the diffusion layer is 35 to 65% by weight based upon total weight of a region of the diffusion layer ranging up to the thickness of at least 2 $\mu$m.

Therefore, it is a primary object of the present invention to provide a ferrous alloy comprising an Fe—Cr stainless steel as a substrate and an Fe—Al diffusion layer on the substrate, which provides improved hardness and wear resistance while keeping the mechanical strength and toughness of the substrate.

It is preferred that the intermetallic compound in the diffusion layer contains at least one selected from the group consisting of $Al_2Fe$, $Al_5Fe_2$, $Al_{13}Fe$ and $Al_{13}Fe_4$. In particular, it is preferred that the diffusion layer includes the intermetallic compound at such an amount that the diffusion layer exhibits at least 10% of a peak ratio which is defined by $100 \times P1/(P1+P2)$ where P1 is a main peak height for the intermetallic compound and P2 is a main peak height for AlFe and $AlFe_3$. The P1 and P2 can be observed from an X-ray diffraction profile obtained through an X-ray diffraction at the outer surface of the diffusion layer.

It is preferred to use as the substrate a precipitation-hardening stainless steel comprising 66 to 81.9 wt % of Fe, 15 to 20 wt % of Cr, 3 to 13 wt % of Ni, and one element selected from 3 to 6 wt % of Cu, 0.5 to 2 wt % of Al, and 0.01 to 0.2 wt % of a total of C and N, or a high carbon stainless steel comprising of 73 to 89.9 wt % of Fe, 10 to 19 wt % of Cr, 0.1 to 1.2 wt % of C, and less than 3 wt % of Ni.

In case of using as the substrate the precipitation-hardening stainless steel, the ferrous alloy of the present invention can be made by the following method. That is, an Al layer is formed on a surface of the substrate to provide an Al-coated substrate. The Al-coated substrate is heated at a temperature of 450 to 600° C. for 0.5 to 4 hours, to thereby give a Vickers hardness of 400 or more to the substrate, and at the same time mutually diffuse Al atoms and Fe atoms respectively into the substrate and the Al layer in such a manner as to form the Fe—Al diffusion layer in the surface of the coated substrate.

On the other hand, in case of using as the substrate the high carbon stainless steel, the ferrous alloy of the present invention can be made by the following method. That is, an Al layer is formed on a surface of the substrate to provide an Al-coated substrate. The Al-coated substrate is heated at a temperature of 900 to 1100° C. for 15 to 180 seconds, to thereby mutually diffuse Al atoms and Fe atoms respectively into the substrate and the Al layer in such a manner as to form the Fe—Al diffusion layer in the surface of the coated substrate. Then, the coated substrate is cooled from the heat-treatment temperature at a cooling rate of 10° C./sec or more to give a Vickers hardness of 400 or more to the substrate.

Other features, advantages and effects of the present invention will become apparent by the detailed explanation below with the attached drawings.

DETAILED DESCRIPTION OF THE INVENTION

A ferrous alloy of the present invention comprises a substrate of an Fe—Cr stainless steel and an Fe—Al diffusion layer on the substrate.

The substrate has a Vickers hardness of 400 or more. In particular, when the present ferrous alloy is used for blades of cutting tools such as electric shavers or hair clippers, it is preferred to use as the substrate a precipitation-hardening stainless steel comprising 66 to 81.9 wt % of Fe, 15 to 20 wt % of Cr, 3 to 13 wt % of Ni, and one element selected from 3 to 6 wt % of Cu, 0.5 to 2 wt % of Al, and 0.01 to 0.2 wt % of a total of C and N, or a high carbon stainless steel comprising of 73 to 89.9 wt % of Fe, 10 to 19 wt % Cr, 0.1 to 1.2 wt % of C, and less than 3 wt % of Ni.

The Fe—Al diffusion layer has a thickness in the range of 2 to 50 μm. When the thickness is less than 2 μm, it is insufficient to give an improved wear resistance to the ferrous alloy. When the thickness is more than 50 μm, there causes problems that the surface hardness of the diffusion layer is lowered, the hardness of the substrate adjacent to the diffusion layer is lowered, or the mechanical toughness of the diffusion layer is deteriorated. In particular, when the ferrous alloy is used for a blade having a sharp edge, it is preferred that the diffusion layer has a thickness of 5 to 15 μm to prevent the occurrence of micro-chippings at the shape edge.

The Al content included within a depth of at least 2 μm of the diffusion layer is 35 to 65% by weight based upon total weight of a region of the diffusion layer ranging up to the thickness of at least 2 μm. When the Al content is less than 35 wt %, it is not enough to give improved hardness and wear resistance to the outer surface of the diffusion layer. When the Al content is more than 65 wt %, a pure Al pool and/or Fe—Al solid solution of a poor hardness is formed in the diffusion layer.

Figure 1:
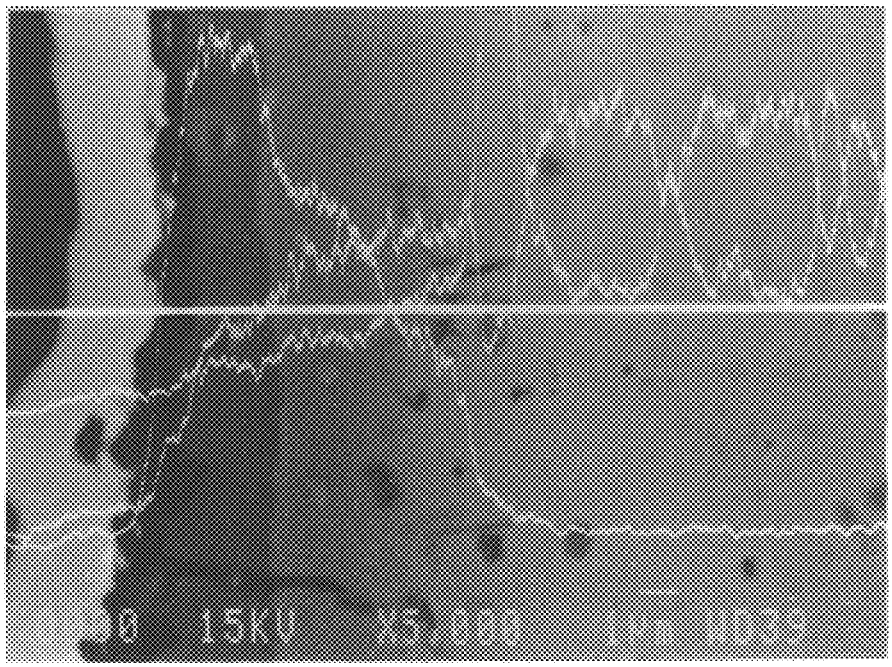
FIG. 1 is a SEM photograph of a cross section of a ferrous alloy of the present invention, with EPMA (Electron Probe Micro Analysis) profiles of Al, Fe and Cr.
Figure 2:
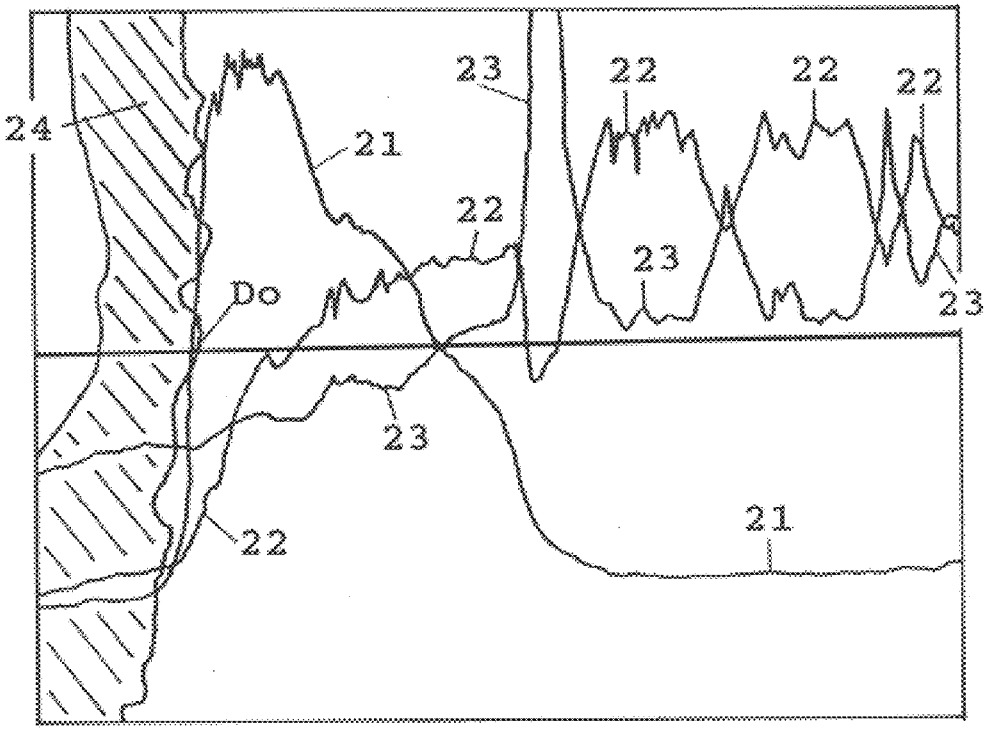
FIG. 2 is an explanation sketch of the EPMA profiles of FIG. 1.

For example, a SEM photograph of a cross section of a diffusion layer having the thickness of about 10 μm is shown in FIG. 1. In addition, EPMA (Electron Probe Micro Analysis) profiles of Al, Fe and Cr, which were analyzed along a horizontal line on the SEM photograph, are shown in FIG. 2. The point $D_0$ corresponds to the outer surface of the diffusion layer. The EPMA profile of Al designated by the numeral 21 shows that the diffusion layer has a surface region with a high concentration of Al, and the Al concentration in the diffusion layer gradually decreases from the surface region toward the depth of about 10 μm. On the other hand, the EPMA profiles of Fe and Cr are designated by the numerals 22 and 23, respectively. The Fe and Cr concentrations gradually increase from the outer surface of the diffusion layer toward the depth of about 10 μm. The numeral 24 designates a Ni coating formed on the diffusion layer to take the SEM photograph.

Figure 3:
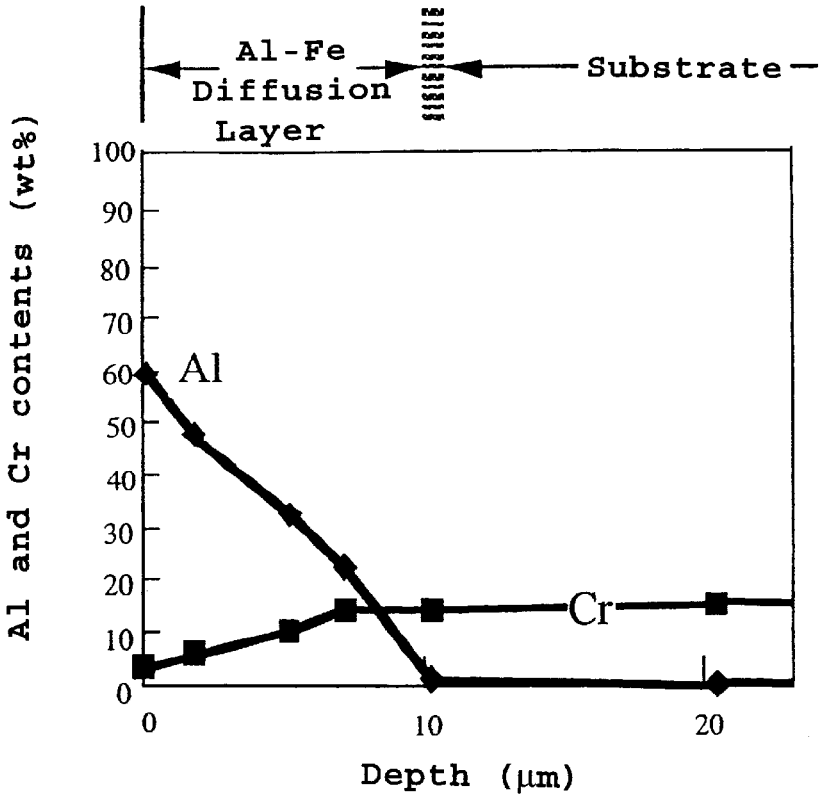
FIG. 3 is curves showing the variations of Al and Cr contents in the depth from the outer surface of a diffusion layer of the ferrous alloy.

FIG. 3 shows the variations of the Al and Cr contents in the depth from the outer surface of the diffusion layer, which were quantitatively analyzed by means of an X-ray micro analysis. The curve of the Al content shows that the Al content included within a depth of about 2 μm from the outer surface of the diffusion layer is in the range of 45 to 60% by weight based upon total weight of a region of the diffusion layer ranging up to the thickness of about 2 μm. Since the Al content of 60 wt % corresponds to about 76 atom %, it could be presumed that $Al_3Fe$ is formed in the outer surface of the diffusion layer.

Figure 4:
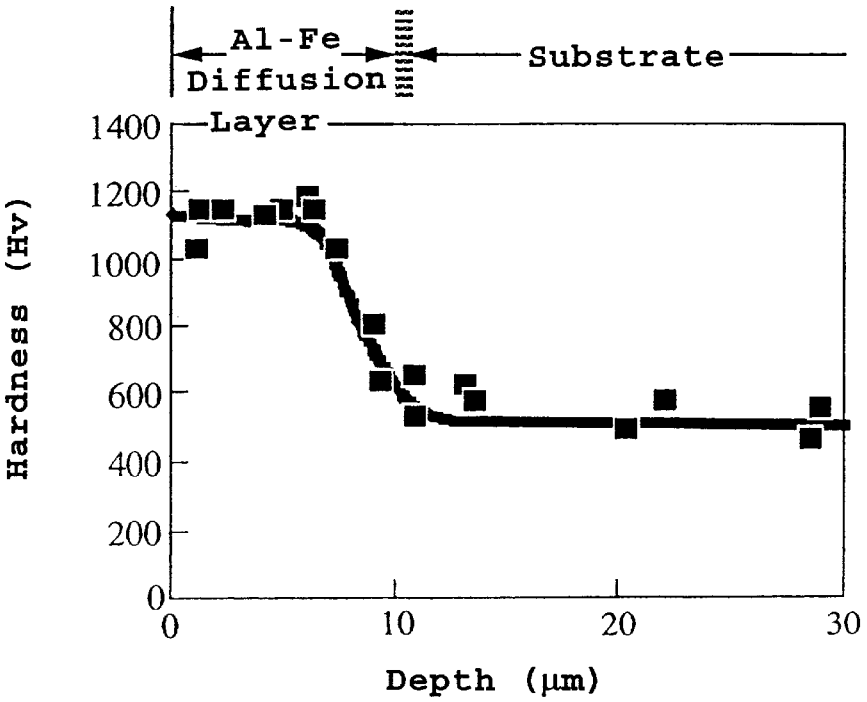
FIG. 4 is a curve showing the variation of Vickers hardness in the depth from the outer surface of the diffusion layer.

The variation of Vickers hardness in the depth from the outer surface of the diffusion layer is shown in FIG. 4. The hardness was measured under the load of 2 gf. From the curve of FIG. 4, it is readily understood that the high hardness (Hv) of about 1140 is stably obtained over the range of the diffusion layer from the outer surface to the depth of about 6 μm. This range of the diffusion layer substantially corresponds to the range of the Al content of 35 to 60 wt %, as shown in FIG. 3. The hardness gradually decreases from the range toward the depth of about 10 μm, and finally reaches about 500 of the substrate hardness.

Figure 5:
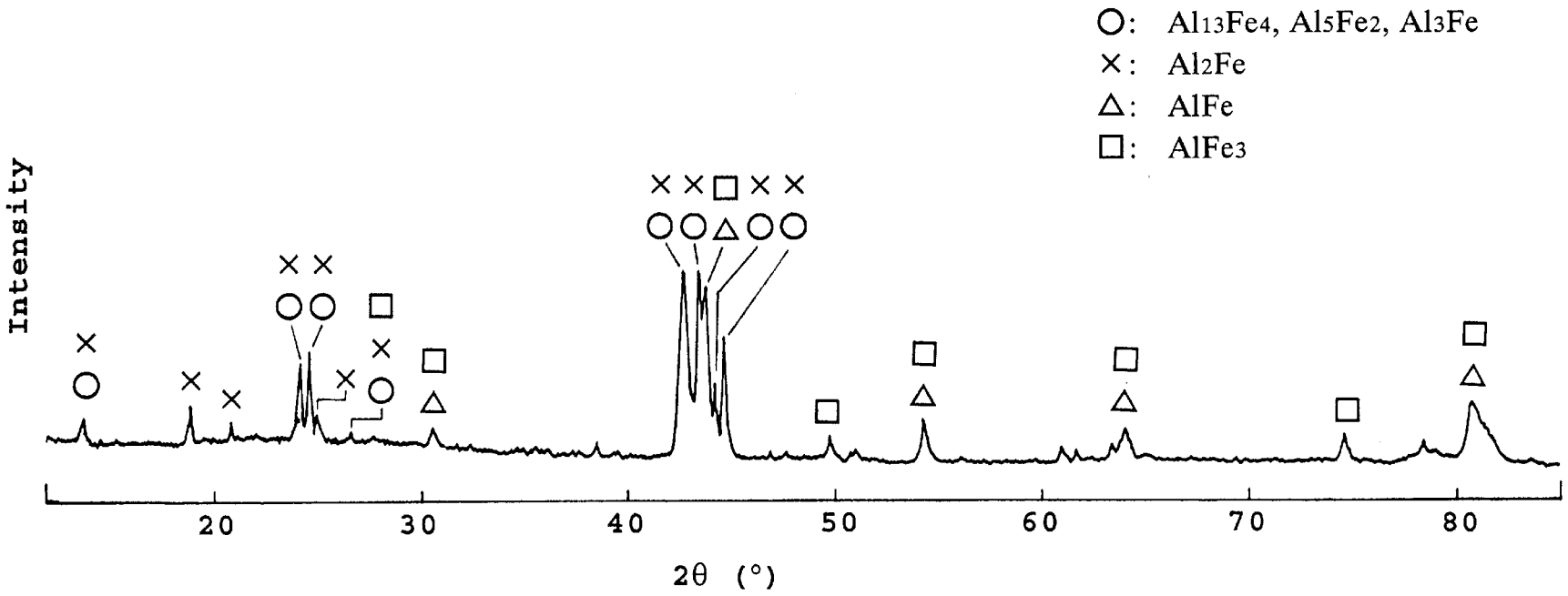
FIG. 5 is an X-ray diffraction profile obtained through an X-ray diffraction at the outer surface of the diffusion layer.

The diffusion layer can be identified by an X-ray diffraction. For example, an X-ray diffraction profile of the diffusion layer is shown in FIG. 5. This X-ray profile was taken by using an X-ray diffraction apparatus with conventional Cu-kαX-ray source and 2θ−θ goniometer at accelerating voltage and current of 40 kV and 200 mA. The X ray was irradiated to the outer surface of the diffusion layer. The X-ray profile shows that the diffusion layer contains a plurality of intermetallic compounds of Fe and Al. Since the peaks of $Al_3Fe$ overlap with the peaks of $Al_{13}Fe_4$ and $Al_5Fe_2$, they can not be separately identified. Therefore, it could be understood that the peaks designated by the symbol ○ in the X-ray profile of FIG. 5 mean the presence of at least one selected from the group consisting of $Al_{13}Fe_4$, $Al_5Fe_2$, and $Al_3Fe$. In addition, some peaks of $Al_2Fe$ designated by the symbol X in the X-ray profile overlap with the peaks of the intermetallic compound designated by the symbol ○. On the other hand, the peaks of AlFe designated by the symbol Δ overlap with the peaks of $AlFe_3$ designated by the symbol □. As a result, it could be concluded that the diffusion layer of this X-ray profile contains $Al_2Fe$, $AlFe_3$ and at least one of $Al_5Fe_2$, $Al_3Fe$ and $Al_{13}Fe_4$. In addition, since the surface region with a high concentration of Al is formed in the vicinity of the outer surface of the diffusion layer, as shown in FIG. 2, and a high Vickers hardness is measured at the surface region of the diffusion layer, as shown in FIG. 4, it could be presumed that there is a relatively large amount of Al-rich and hard intermetallic compounds such as $Al_{13}Fe_4$, $Al_3Fe$ and $Al_5Fe_2$, in the vicinity of the outer surface of the diffusion layer.

In the present invention, the diffusion layer contains at least 90 vol % of an intermetallic compound of Al and Fe relative to a total volume of the diffusion layer. The volume ratio (V: vol %) can be determined by the following equation:

$$V\ (\text{vol}\ \%)=100\times S1/(S1+S2)$$

where S1 is a total of the peak-areas of all Al—Fe intermetallic compounds identified on an X-ray diffraction profile, and S2 is a total of the peak-areas of pure Al, and/or an Al alloy in which Fe mainly forms a solid solution with Al, except for the Al—Fe intermetallic compounds on the X-ray profile. When the volume ratio is less than 90 vol %, the hardness of the diffusion layer is lowered because of the pure Al and the Al alloy remained in the diffusion layer. For example, the peaks of pure Al and the Al alloy are not identified on the X-ray profile of FIG. 5, therefore, the volume ratio of the Al—Fe intermetallic compound in the diffusion layer is 100 vol %.

By the way, the X-ray profile of FIG. 5 does not show any peak of the substrate. However, as the thickness of the diffusion layer is thinner, some peaks of the substrate may appear. On the other hand, when the Al content at the outer surface of the diffusion layer is more than 65 wt %, some peaks of pure Al may be identified. In addition, it should be noted that no peak of $Al_2O_3$ is identified in the X-ray profile. In other words, any $Al_2O_3$ layer is not formed in the outer surface of the diffusion layer of the present invention. Moreover, the diffusion layer contains a small amount of Cr, as shown in FIG. 3. However, any intermetallic compound of Al and Cr is not identified in the X-ray profile of FIG. 5. Even if a small amount of Al—Cr intermetallic compound is formed in the diffusion layer, there is no problem because the hardness of the diffusion layer is not lowered.

The diffusion layer of the present invention preferably includes the Al-rich intermetallic compound at such an amount that the diffusion layer exhibits at least 10% of a peak ratio (P %) which is defined by the following equation:

$$P\ (\%)=100\times P1/(P1+P2)$$

where P1 is a main peak height for the Al-rich intermetallic compound of at least one selected from the group consisting of $Al_{13}Fe_4$, $Al_5Fe_2$, $Al_3Fe$, and $Al_2Fe$, and P2 is a main peak height for AlFe and $AlFe_3$. The P1 and P2 can be observed from an X-ray diffraction profile obtained through an X-ray diffraction at the outer surface of the diffusion layer. In the X-ray profile of FIG. 5, the peak ratio can be determined according to the main peak height P1 observed at about 43.3° and the main peak height P2 observed at about 43.7°. The peak ratio is about 50%.

Next, methods of making the ferrous alloy of the present invention are introduced. In case of using as the substrate the precipitation-hardening stainless steel, the ferrous alloy is made by the following method. That is, an Al layer is formed on a surface of the substrate to provide an Al-coated substrate. The Al layer may be formed by means of hot dipping, electro-plating, vacuum deposition, cladding, or sandwich rolling. The Al-coated substrate is heated at a temperature of 450 to 600° C. for a keeping time of 0.5 to 4 hours, to thereby mutually diffuse Al atoms and Fe atoms respectively into the substrate and the Al layer in such a manner as to form the above-explained diffusion layer in the surface of the coated substrate. In addition, the precipitation hardening of the substrate is caused by the heat treatment, so that the hardness of the substrate reaches at least 400 of Vickers hardness. Since the diffusion layer is formed through the mutual diffusion between metal elements of the substrate, e.g., Fe and Cr, and Al of the Al layer, it is possible to provide excellent adhesion between the diffusion layer and substrate. When the temperature is less than 450° C. or the keeping time is less than 0.5 hours, the mutual diffusion is insufficient to form the diffusion layer, and also it is difficult to achieve the precipitation hardening of the substrate. When the temperature is more than 600° C. or the keeping time is more than 4 hours, the precipitation hardening is excessively proceeded, so that the hardness of the substrate is lowered. Therefore, it is preferred that as the heat-treatment temperature is increased between 450 and 600° C., the keeping time is decreased in the range of 0.5 to 4 hours.

On the other hand, in case of using as the substrate the high carbon stainless steel, the ferrous alloy is made by the following method. That is, an Al layer is formed on a surface of the substrate to provide an Al-coated substrate. The Al-coated substrate is heated at a temperature of 900 to 1100° C. for a keeping time of 15 to 180 seconds, to thereby mutually diffuse Al atoms and Fe atoms respectively into the substrate and the Al layer in such a manner as to form the above-explained diffusion layer in the surface of the coated substrate. Subsequently, the coated substrate is cooled from the temperature at a cooling rate of 10 ° C./sec or more. A quench hardening of the substrate is caused by the cooling step, so that the hardness of the substrate reaches at least 400 of Vickers hardness. When the cooling rate is less than 10° C./sec, the hardness of the substrate can be not improved by the quench hardening. When the temperature is less than 900° C., the effect of the quench hardening is not enough. When the temperature is more than 1100° C., or the keeping time is more than 180 seconds, the hardness of the diffusion layer or the hardness of the substrate adjacent to the diffusion layer is lowered because of a rapid diffusion of Al atoms into the substrate. On the other hand, when the keeping time is less than 15 seconds, the mutual diffusion between metal elements of the substrate and Al of the Al layer is insufficient to form the diffusion layer, and also the quench hardening is not uniformly performed to the substrate. Therefore, it is preferred that as the heat-treatment temperature is increased between 900 and 1100° C., the keeping time is decreased in the range of 15 to 180 seconds.

EXAMPLE 1

A high carbon stainless steel sheet having the thickness of 3 mm was used as a substrate. The stainless steel consists of 13.5 wt % of Cr, 1.2 wt % of Mo, 0.4 wt % of C, and the balance of Fe. Al layers having the thickness of 45 $\mu$m were formed on opposite surfaces of the substrate by means of electric-plating to obtain an Al-coated substrate having the thickness of 3.09 mm. As listed on Table 1, the Al-coated substrate was heated at 1050° C. for 180 seconds in the air, and then cooled at the rate of 60° C./sec to obtain a ferrous alloy of Example 1.

The ferrous alloy has an Fe—Al diffusion layer having the thickness of 45 $\mu$m. The Vickers hardness of the substrate is 600. The surface hardness of the diffusion layer is 900. The hardness was measured under the load of 2 gf. In accordance with an X-ray diffraction profile obtained through an X-ray diffraction at the outer surface of the diffusion layer, a volume ratio (V: vol %) of Al—Fe intermetallic compounds in the diffusion layer was determined by the following equation:

$$V\ (\text{vol}\ \%)=100\times S1/(S1+S2)$$

where S1 is a total of the peak-areas of all Al—Fe intermetallic compounds identified on the X-ray profile, and S2 is a total of the peak-areas of pure Al, and/or an Al alloy in which Fe mainly forms a solid solution with Al, except for the Al—Fe intermetallic compounds on the X-ray profile. In Example 1, the volume ratio is 97 vol %.

In addition, a peak ratio (P: %) was determined by the following equation:

$$P\ (\%)=100\times P1/(P1+P2)$$

where P1 is a peak height of the main peak (about 43.3°) of Al-rich intermetallic compounds ($Al_2Fe$ $Al_{13}Fe_4$, $Al_3Fe$ and/or $Al_5Fe_2$), and P2 is a peak height of the main peak (about 43.7°) of another Fe—Al intermetallic compounds (AlFe and/or $AlFe_3$). In Example 1, the peak ratio is 40%.

The Al content included within the depth of about 2 μm from the outer surface of the diffusion layer was determined by means of X-ray micro analysis. In Example 1, the Al content is 45% by weight based upon total weight of a region of the diffusion layer ranging up to the thickness of about 2 μm.

The same analysises and measurements as Example 1 were performed in Examples and Comparative Examples described below.

EXAMPLE 2

A high carbon stainless steel sheet having the thickness of 0.2 mm was used as a substrate. The stainless steel consists of 13.5 wt % of Cr, 1.2 wt % of Mo, 0.4 wt % of C, and the balance of Fe. After Al foils were placed on opposite surfaces of the substrate, the substrate with Al foils was rolled to obtain an Al-cladded substrate having Al layers of 20 μm thickness. As listed on Table 1, the cladded substrate was heated at 975° C. for 120 seconds in the air, and then cooled at the rate of 15° C./sec to obtain a ferrous alloy of Example 2.

The ferrous alloy has an Fe—Al diffusion layer having the thickness of 20 μm. The Vickers hardness of the substrate is 480. The surface hardness of the diffusion layer is 1020.

EXAMPLE 3

A high carbon stainless steel sheet having the thickness of 0.1 mm was used as a substrate. The stainless steel consists of 16.5 wt % of Cr, 0.9 wt % of C, 0.4 wt % of Mo, and the balance of Fe. After Al foils having the thickness of 15 μm were placed on opposite surfaces of the substrate, the substrate with Al foils was rolled to obtain an Al-cladded substrate having the thickness of 0.12 mm. As listed on Table 1, the cladded substrate was heated at 1000° C. for 30 seconds in the air, and then cooled at the rate of 10° C./sec to obtain a ferrous alloy of Example 3.

The ferrous alloy has an Fe—Al diffusion layer having the thickness of 13 μm. The Vickers hardness of the substrate is 500. The surface hardness of the diffusion layer is 1000.

EXAMPLE 4

A high carbon stainless steel sheet having the thickness of 0.2 mm was used as a substrate. The stainless steel consists of 12.5 wt % of Cr, 0.7 wt % of C, and the balance of Fe. After Al foils were placed on opposite surfaces of the substrate, the substrate with Al foils was rolled to obtain an Al-cladded substrate having Al layers of 8 μm thickness. As listed on Table 1, the cladded substrate was heated at 900° C. for 180 seconds in the air, and then cooled at the rate of 30° C./sec to obtain a ferrous alloy of Example 4.

The ferrous alloy has an Fe—Al diffusion layer having the thickness of 8 μm. The Vickers hardness of the substrate is 420. The surface hardness of the diffusion layer is 1100.

EXAMPLE 5

A high carbon stainless steel sheet having the thickness of 0.3 mm was used as a substrate. The stainless steel consists of 14 wt % of Cr, 1.1 wt % of C, and the balance of Fe. After Al foils were placed on opposite surfaces of the substrate, the substrate with Al foils was rolled to obtain an Al-cladded substrate having Al layers of 15 μm thickness. As listed on Table 1, the cladded substrate was heated at 1100° C. for 15 seconds in the air, and then cooled at the rate of 20° C./sec to obtain a ferrous alloy of Example 5.

The ferrous alloy has an Fe—Al diffusion layer having the thickness of 15 μm. The Vickers hardness of the substrate is 550. The surface hardness of the diffusion layer is 810.

EXAMPLE 6

A high carbon stainless steel sheet having the thickness of 0.18 mm was used as a substrate. The stainless steel consists of 14 wt % of Cr, 1.0 wt % of C, and the balance of Fe. After Al layers having the thickness of 3 μm were formed on opposite surfaces of the substrate by a vacuum deposition of Al to obtain an Al-coated substrate. As listed on Table 1, the coated substrate was heated at 1000° C. for 15 seconds in a mixture gas of Ar and $N_2$, and then cooled at the rate of 10° C./sec to obtain a ferrous alloy of Example 6.

The ferrous alloy has an Fe—Al diffusion layer having the thickness of 3 μm. The Vickers hardness of the substrate is 550. The surface hardness of the diffusion layer is 700.

EXAMPLE 7

A high carbon stainless steel sheet having the thickness of 0.15 mm was used as a substrate. The stainless steel consists of 13.5 wt % of Cr, 1.2 wt % of Mo, 0.4 wt % of C and the balance of Fe. After Al foils were placed on opposite surfaces of the substrate, the substrate with Al foils was rolled to obtain an Al-cladded substrate having Al layers of 10 μm thickness. As listed on Table 1, the cladded substrate was heated at 975° C. for 30 seconds in the air, and then cooled at the rate of 15° C./sec to obtain a ferrous alloy of Example 7.

The ferrous alloy has an Fe—Al diffusion layer having the thickness of 10 μm. Th e Vickers hardness of the substrate is 500. The surface hardness of the diffusion layer is 1140.

EXAMPLE 8

A high carbon stainless steel sheet having the thickness of 0.5 mm was used as a substrate. The stainless steel consists of 13.5 wt % of Cr, 1.2 wt % of Mo, 0.4 wt % of C, and the balance of Fe. After Al foils having the thickness of 6 μm were placed on opposite surfaces of the substrate, the substrate with Al foils was rolled to obtain an Al-cladded substrate. As listed on Table 1, the cladded substrate was heated at 925 ° C. for 60 seconds in the air, and then cooled at the rate of 30° C./sec to obtain a ferrous alloy of Example 8.

The ferrous alloy has an Fe—Al diffusion layer having the thickness of 5 μm. The Vickers hardness of the substrate is 450. The surface hardness of the diffusion layer is 1150.

EXAMPLE 9

A high carbon stainless steel sheet having the thickness of 2 mm was used as a substrate. The stainless steel consists of 13.5 wt % of Cr, 1.2 wt % of Mo, 0.4 wt % of C, and the balance of Fe. After Al layers having the thickness of 30 μm were formed on opposite surfaces of the substrate by a vacuum deposition of Al to obtain an Al-coated substrate. As listed on Table 1, the coated substrate was heated at 1100° C. for 90 seconds in a mixture gas of Ar and $N_2$, and then cooled at the rate of 20 ° C./sec to obtain a ferrous alloy of Example 9.

The ferrous alloy has an Fe—Al diffusion layer having the thickness of 30 μm. The Vickers hardness of the substrate is 550. The surface hardness of the diffusion layer is 630.

EXAMPLE 10

A precipitation-hardening stainless steel sheet having the thickness of 0.5 mm was used as a substrate. The stainless steel consists of 18 wt % of Cr, 12 wt % of Ni, 0.1 wt % of (C+N), and the balance of Fe. After Al foils having the thickness of 13 μm were placed on opposite surfaces of the substrate, the substrate with Al foils was rolled to obtain an Al-cladded substrate having the thickness of 0.48 mm. In addition, the cladded substrate was cold-rolled to have the thickness of 0.2 mm. As listed on Table 1, the cladded substrate was then heated at 550° C. for 2 hours in Ar gas to obtain a ferrous alloy of Example 10.

The ferrous alloy has an Fe—Al diffusion layer having the thickness of 5 μm. The Vickers hardness of the substrate is 550. The surface hardness of the diffusion layer is 1100.

EXAMPLE 11

A precipitation-hardening stainless steel sheet having the thickness of 0.5 mm was used as a substrate. The stainless steel consists of 18 wt % of Cr, 12 wt % of Ni, 0.1 wt % of (C+N), and the balance of Fe. After Al foils having the thickness of 9 μm were placed on opposite surfaces of the substrate, the substrate with Al foils was rolled to obtain an Al-cladded substrate having the thickness of 0.48 mm. In addition, the cladded substrate was cold-rolled to have the thickness of 0.2 mm. As listed on Table 1, the cladded substrate was then heated at 500° C. for 4 hours in Ar gas to obtain a ferrous alloy of Example 11.

The ferrous alloy has an Fe—Al diffusion layer having the thickness of 3 μm. The Vickers hardness of the substrate is 450. The surface hardness of the diffusion layer is 1100.

EXAMPLE 12

A precipitation-hardening stainless steel sheet having the thickness of 0.5 mm was used as a substrate. The stainless steel consists of 18 wt % of Cr, 12 wt % of Ni, 0.05 wt % of (C+N), and the balance of Fe. After Al foils having the thickness of 9 μm were placed on opposite surfaces of the substrate, the substrate with Al foils was rolled to obtain an Al-cladded substrate having the thickness of 0.48 mm. In addition, the cladded substrate was cold-rolled to have the thickness of 0.2 mm. As listed on Table 1, the cladded substrate was then heated at 600° C. for 2 hours in Ar gas to obtain a ferrous alloy of Example 12.

The ferrous alloy has an Fe—Al diffusion layer having the thickness of 3 μm. The Vickers hardness of the substrate is 500. The surface hardness of the diffusion layer is 850.

EXAMPLE 13

A precipitation-hardening stainless steel sheet having the thickness of 1 mm was used as a substrate. The stainless steel consists of 16 wt % of Cr, 4 wt % of Ni, 4 wt % of Cu, and the balance of Fe. A pre-treatment for forming solid solutions was performed to the substrate at 1050° C. After Al foils having the thickness of 6 μm were placed on opposite surfaces of the treated substrate, the substrate with Al foils was rolled to obtain an Al-cladded substrate. As listed on Table 1, the cladded substrate was heated at 490° C. for 4 hours in the air to obtain a ferrous alloy of Example 13.

The ferrous alloy has an Fe—Al diffusion layer having the thickness of 5 μm. The Vickers hardness of the substrate is 400. The surface hardness of the diffusion layer is 1150.

EXAMPLE 14

A precipitation-hardening stainless steel sheet having the thickness of 0.2 mm was used as a substrate. The stainless steel consists of 17 wt % of Cr, 7 wt % of Ni, 1 wt % of Al, and the balance of Fe. A pre-treatment for forming solid solutions was performed to the substrate at 1000° C. After Al foils having the thickness of 6 μm were placed on opposite surfaces of the treated substrate, the substrate with Al foils was rolled to obtain an Al-cladded substrate. As listed on Table 1, the cladded substrate was heated at 575° C. for 1.5 hours in the air to obtain a ferrous alloy of Example 14.

The ferrous alloy has an Fe—Al diffusion layer having the thickness of 6 μm. The Vickers hardness of the substrate is 400. The surface hardness of the diffusion layer is 1100.

EXAMPLE 15

A precipitation-hardening stainless steel sheet having the thickness of 0.2 mm was used as a substrate. The stainless steel consists of 17 wt % of Cr, 7 wt % of Ni, 1 wt % of Al, and the balance of Fe. A pre-treatment for forming solid solutions was performed to the substrate at 1050° C. Al layers having the thickness of 3 μm were formed on opposite surfaces of the treated substrate by a vacuum deposition of Al to obtain an Al-coated substrate. As listed on Table 1, the coated substrate was heated at 575° C. for 1.5 hours in the air to obtain a ferrous alloy of Example 15.

The ferrous alloy has an Fe—Al diffusion layer having the thickness of 3 μm. The Vickers hardness of the substrate is 410. The surface hardness of the diffusion layer is 950.

Comparative Example 1

A high carbon stainless steel sheet having the thickness of 0.15 mm was used as a substrate. The stainless steel consists of 13.5 wt % of Cr, 1.2 wt % of Mo, 0.4 wt % of C, and the balance of Fe. After Al foils were placed on opposite surfaces of the substrate, the substrate with Al foils was rolled to obtain an Al-cladded substrate having the thickness of 10 μm. As listed on Table 1, the cladded substrate was heated at 1150° C. for 120 seconds in the air, and then cooled at the rate of 20° C./sec to obtain a ferrous alloy of Comparative Example 1.

The ferrous alloy has an Fe—Al diffusion layer having the thickness of 10 μm. The Vickers hardness of the substrate is 300. The surface hardness of the diffusion layer is 400. It was identified by an X-ray diffraction analysis that the diffusion layer does not contain Al-rich intermetallic compounds of $Al_2Fe$, $Al_{13}Fe_4$, $Al_3Fe$ and $Al_5Fe_2$. However, since it was identified that the diffusion layer contains another intermetallic compounds of AlFe and $AlFe_3$, the volume ratio was determined.

Comparative Example 2

A high carbon stainless steel sheet having the thickness of 0.18 mm was used as a substrate. The stainless steel consists of 13.5 wt % of Cr, 1.2 wt % of Mo, 0.4 wt % of C, and the balance of Fe. After Al foils were placed on opposite surfaces of the substrate, the substrate with Al foils was rolled to obtain an Al-cladded substrate having the thickness of 10 μm. As listed on Table 1, the cladded substrate was heated at 850° C. for 60 seconds in the air, and then cooled at the rate of 30° C./sec to obtain a ferrous alloy of Comparative Example 2.

The ferrous alloy has an Fe—Al diffusion layer having the thickness of 10 μm. The Vickers hardness of the substrate is 350. The surface hardness of the diffusion layer is 1200.

Comparative Example 3

A high carbon stainless steel sheet having the thickness of 0.15 mm was used as a substrate. The stainless steel consists of 13.5 wt % of Cr, 1.2 wt % of Mo, 0.4 wt % of C, and the balance of Fe. After Al foils were placed on opposite surfaces of the substrate, the substrate with Al foils was rolled to obtain an Al-cladded substrate having the thickness of 10 μm. As listed on Table 1, the cladded substrate was heated at 975° C. for 5 seconds in the air, and then cooled at the rate of 15° C./sec to obtain a ferrous alloy of Comparative Example 3.

The ferrous alloy has an Fe—Al diffusion layer having the thickness of 10 μm. The Vickers hardness of the substrate is 350. The surface hardness of the diffusion layer is 350. It was identified by an X-ray diffraction analysis that the diffusion layer does not contain Al-rich intermetallic compounds of $Al_2Fe$, $Al_{13}Fe_4$, $Al_3Fe$ and $Al_5Fe_2$. However, since it was identified that the diffusion layer contains another intermetallic compounds of AlFe and $AlFe_3$, the volume ratio was determined. In addition, it was identified that the diffusion layer contains pure Al.

Comparative Example 4

A high carbon stainless steel sheet having the thickness of 0.15 mm was used as a substrate. The stainless steel consists of 13.5 wt % of Cr, 1.2 wt % of Mo, 0.4 wt % of C, and the balance of Fe. After Al foils were placed on opposite surfaces of the substrate, the substrate with Al foils was rolled to obtain an Al-cladded substrate having the thickness of 10 μm. As listed on Table 1, the cladded substrate was heated at 975° C. for 240 seconds in the air, and then cooled at the rate of 15° C./sec to obtain a ferrous alloy of Comparative Example 4.

The ferrous alloy has an Fe—Al diffusion layer having the thickness of 10 μm. The Vickers hardness of the substrate is 400. The surface hardness of the diffusion layer is 450. It was identified by an X-ray diffraction analysis that the diffusion layer does not contain Al-rich intermetallic compounds of $Al_2Fe$, $Al_{13}Fe_4$, $Al_3Fe$ and $Al_5Fe_2$. However, since it was identified that the diffusion layer contains another intermetallic compounds of AlFe and $AlFe_3$, the volume ratio was determined.

Comparative Example 5

A high carbon stainless steel sheet having the thickness of 0.15 mm was used as a substrate. The stainless steel consists of 13.5 wt % of Cr, 1.2 wt % of Mo, 0.4 wt % of C, and the balance of Fe. After Al foils were placed on opposite surfaces of the substrate, the substrate with Al foils was rolled to obtain an Al-cladded substrate having the thickness of 10 μm. As listed on Table 1, the cladded substrate was heated at 975° C. for 30 seconds in the air, and then cooled at the rate of 3° C./sec to obtain a ferrous alloy of Comparative Example 5.

The ferrous alloy has an Fe—Al diffusion layer having the thickness of 10 μm. The Vickers hardness of the substrate is 380. The surface hardness of the diffusion layer is 1150.

Comparative Example 6

A high carbon stainless steel sheet having the thickness of 3 mm was used as a substrate. The stainless steel consists of 14 wt % of Cr, 0.2 wt % of C, and the balance of Fe. Al layers having the thickness of 60 μm were formed on opposite surfaces of the substrate by an electric-plating of Al to obtain an Al-coated substrate. As listed on Table 1, the coated substrate was heated at 1100° C. for 150 seconds in the air, and then cooled at the rate of 60° C./sec to obtain a ferrous alloy of Comparative Example 6.

The ferrous alloy has an Fe—Al diffusion layer having the thickness of 60 μm. The Vickers hardness of the substrate is 460. The surface hardness of the diffusion layer is 950.

Comparative Example 7

A high carbon stainless steel sheet having the thickness of 0.27 mm was used as a substrate. The stainless steel consists of 9 wt % of Cr, 0.5 wt % of C, and the balance of Fe. Al layers having the thickness of 1 μm were formed on opposite surfaces of the substrate by a vacuum deposition of Al to obtain an Al-coated substrate. As listed on Table 1, the coated substrate was heated at 950° C. for 15 seconds in the air, and then cooled at the rate of 10° C./sec to obtain a ferrous alloy of Comparative Example 7.

The ferrous alloy has an Fe—Al diffusion layer having the thickness of 1 μm. The Vickers hardness of the substrate is 450. The surface hardness of the diffusion layer, Al content, peak ratio and volume ratio could not be determined because the thickness of the diffusion layer is very thin.

Comparative Example 8

A precipitation-hardening stainless steel sheet having the thickness of 0.5 mm was used as a substrate. The stainless steel consists of 18 wt % of Cr, 12 wt % of Ni, 0.05 wt % of (C+N), and the balance of Fe. The substrate was cold-rolled to have the thickness of 0.2 mm. Al layers having the thickness of 1 μm were then formed on opposite surfaces of the substrate by a vacuum deposition of Al to obtain an Al-coated substrate. As listed on Table 1, the coated substrate was heated at 600° C. for 2 hours in Ar gas to obtain a ferrous alloy of Comparative Example 8.

The ferrous alloy has an Fe—Al diffusion layer having the thickness of 1 μm. The Vickers hardness of the substrate is 500. The surface hardness of the diffusion layer, Al content, peak ratio and volume ratio could not be determined because the thickness of the diffusion layer is very thin.

Comparative Example 9

A precipitation-hardening stainless steel sheet having the thickness of 0.5 mm was used as a substrate. The stainless steel consists of 18 wt % of Cr, 12 wt % of Ni, 0.05 wt % of (C+N), and the balance of Fe. After Al foils having the thickness of 9 μm were placed on opposite surfaces of the substrate, the substrate with Al foils was cladded to obtain an Al-cladded substrate having the thickness of 0.48 mm. In addition, the cladded substrate was cold-rolled to have the thickness of 0.2 mm. As listed on Table 1, the cladded substrate was then heated at 600° C. for 0.3 hours in Ar gas to obtain a ferrous alloy of Comparative Example 9.

The ferrous alloy has an Fe—Al diffusion layer having the thickness of 3 μm. The Vickers hardness of the substrate is 400. The surface hardness of the diffusion layer is 300. It was identified by an X-ray diffraction analysis that the diffusion layer does not contain Al-rich intermetallic compounds of $Al_2Fe$, $Al_{13}Fe_4$, $Al_3Fe$ and $Al_5Fe_2$. However, since it was identified that the diffusion layer contains another intermetallic compounds of AlFe and $AlFe_3$, the volume ratio was determined. In addition, it was identified that the diffusion layer contains pure Al.

Comparative Example 10

A precipitation-hardening stainless steel sheet having the thickness of 0.5 mm was used as a substrate. The stainless steel consists of 18 wt % of Cr, 12 wt % of Ni, 0.05 wt % of (C+N), and the balance of Fe. After Al foils having the thickness of 9 μm were placed on opposite surfaces of the substrate, the substrate with Al foils was cladded to obtain an Al-cladded substrate having the thickness of 0.48 mm. In addition, the cladded substrate was cold-rolled to have the thickness of 0.2 mm. As listed on Table 1, the cladded substrate was then heated at 600° C. for 6 hours in Ar gas to obtain a ferrous alloy of Comparative Example 10.

The ferrous alloy has an Fe—Al diffusion layer having the thickness of 3 μm. The Vickers hardness of the substrate is 450. The surface hardness of the diffusion layer is 450. It was identified by an X-ray diffraction analysis that the diffusion layer does not contain Al-rich intermetallic compounds of $Al_2Fe$, $Al_{13}Fe_4$, $Al_3Fe$ and $Al_5Fe_2$. However, since it was identified that the diffusion layer contains another intermetallic compounds of AlFe and $AlFe_3$, the volume ratio was determined.

Comparative Example 11

A precipitation-hardening stainless steel sheet having the thickness of 0.5 mm was used as a substrate. The stainless steel consists of 18 wt % of Cr, 12 wt % of Ni, 0.05 wt % of (C+N), and the balance of Fe. After Al foils having the thickness of 9 μm were placed on opposite surfaces of the substrate, the substrate with Al foils was cladded to obtain an Al-cladded substrate having the thickness of 0.48 mm. In addition, the cladded substrate was cold-rolled to have the thickness of 0.2 mm. As listed on Table 1, the cladded substrate was then heated at 650° C. for 2 hours in Ar gas to obtain a ferrous alloy of Comparative Example 11.

The ferrous alloy has an Fe—Al diffusion layer having the thickness of 3 μm. The Vickers hardness of the substrate is 450. The surface hardness of the diffusion layer is 500.

Comparative Example 12

A precipitation-hardening stainless steel sheet having the thickness of 1 mm was used as a substrate. The stainless steel consists of 16 wt % of Cr, 4 wt % of Ni, 4 wt % of Cu, and the balance of Fe. A pre-treatment for forming solid solutions was performed to the substrate at 1050° C. After Al foils having the thickness of 6 μm were placed on opposite surfaces of the treated substrate, the substrate with Al foils was rolled to obtain an Al-cladded substrate. As listed on Table 1, the cladded substrate was heated at 400° C. for 4 hours in Ar gas to obtain a ferrous alloy of Comparative Example 12.

The ferrous alloy has an Fe—Al diffusion layer having the thickness of 5 μm. The Vickers hardness of the substrate is 300. The surface hardness of the diffusion layer is 250. It was identified by an X-ray diffraction analysis that the diffusion layer contains pure Al.

With respect to Examples 1 to 15 and Comparative Examples 1 to 12, the composition of the substrate and heat-treatment conditions are listed on Table. 1. The thickness (μm) and Vickers hardness (Hv) of the diffusion layer, Al content (wt %) included within a depth of about 2 μm from the outer surface of the diffusion layer, volume ratio (vol %) of Al—Fe intermetallic compounds relative to a total volume of the diffusion layer, X-ray peak ratio (%) of the Al—Fe intermetallic compounds, and Vickers hardness (Hv) of the substrate are listed on Table 2.

Figure 6:
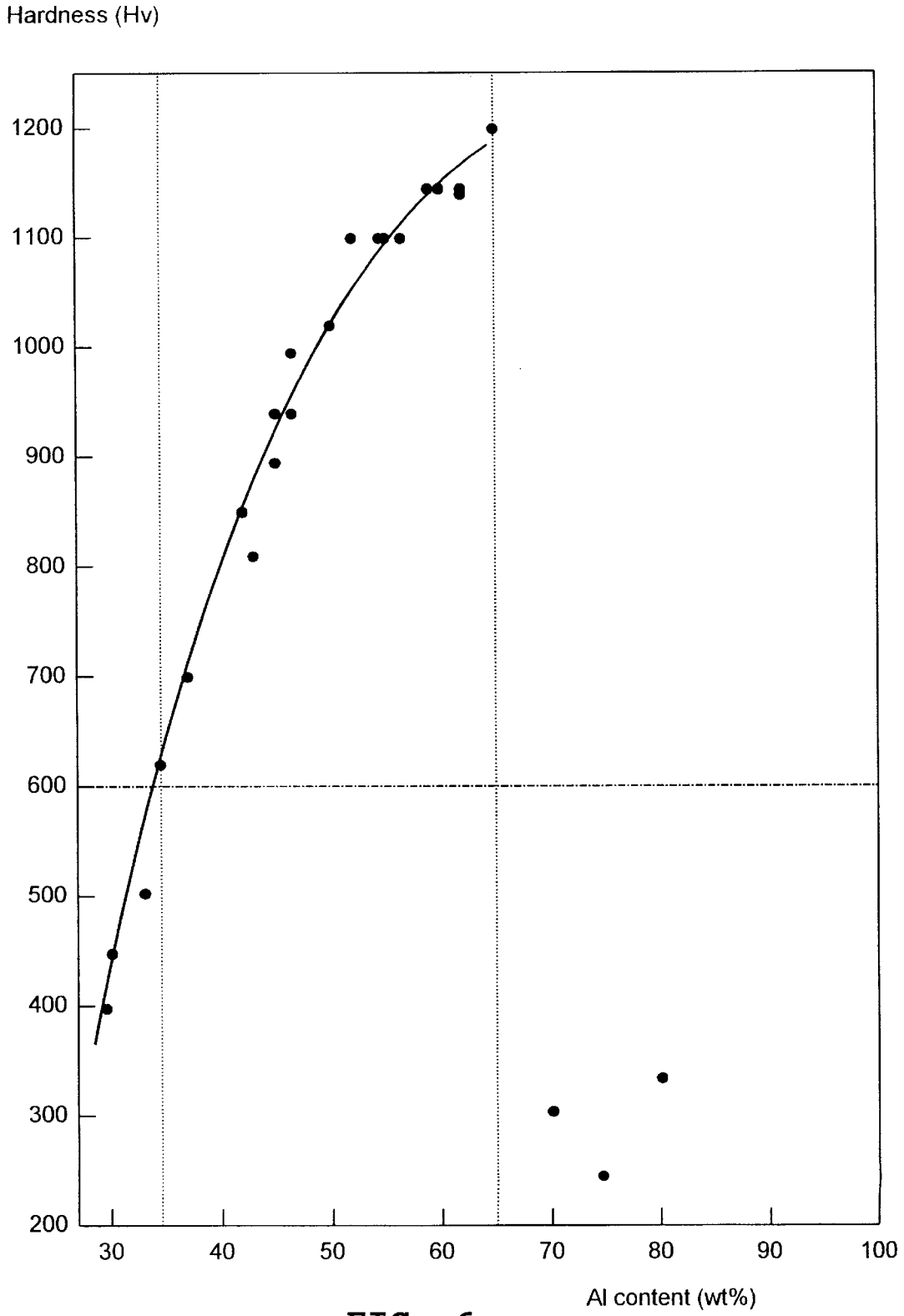
FIG. 6 is a curve showing the relation between the surface hardness (vertical axis) of the diffusion layer and the Al content (horizontal axis) included within the depth of about 2 μm from the outer surface of the diffusion layer.

FIG. 6 shows the relation between the surface hardness (Hv) of the diffusion layer and the Al content (wt %), which is determined according to the results of the above-explained Examples and Comparative Examples. From the curve of FIG. 6, it could be understood that when the Al content is in the range of 35 to 65 wt %, it is possible to obtain the diffusion layer having a higher hardness between 600 and 1200. On the contrary, when the Al content is less than 35 wt % or more than 65 wt %, the hardness of the diffusion layer is considerably lowered.

In Comparative Example 6, the diffusion layer and the substrate have 950 and 460 of the hardness, respectively. However, when blades for an electric shaver were machined by the use of the ferrous alloy of Comparative Example 6, a large number of micro-chippings occurred at the sharp edges of the blades because the thickness of the diffusion layer is thick (≈60 μm).

Figure 7:
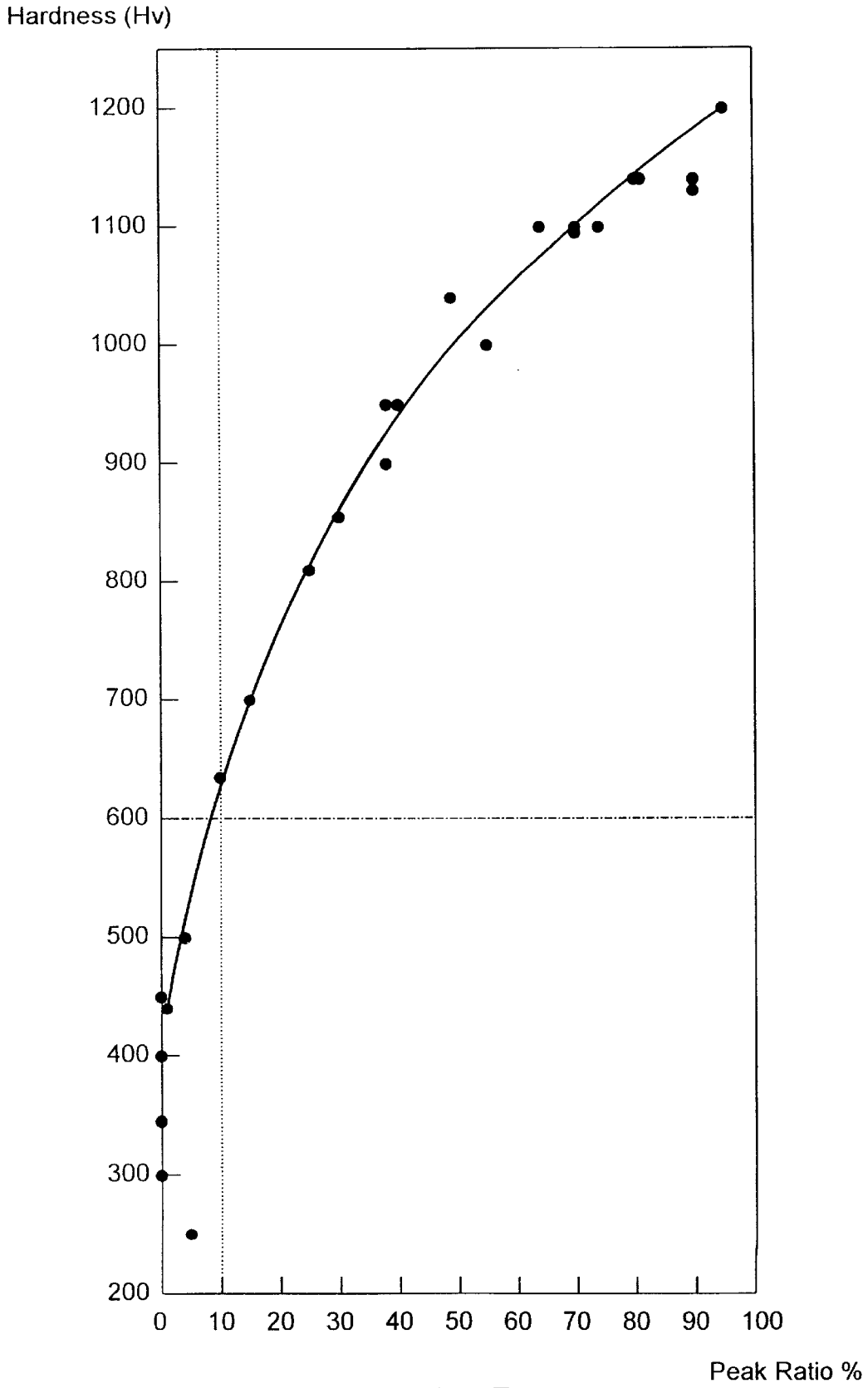
FIG. 7 is a curve showing the relation between the surface hardness (vertical axis) of the diffusion layer and the peak ratio (horizontal axis) of Fe—Al intermetallic compounds.

On the other hand, FIG. 7 shows the relation between the surface hardness (Hv) of the diffusion layer and the peak ratio (P %), which is determined according to the results of the above-explained Examples and Comparative Examples. From the curve of FIG. 7, it could be understood that when the peak ratio is 10% or more, it is possible to obtain the diffusion layer having a high hardness between 600 and 1200.

Thus, since the ferrous alloy of the present invention can provide a high hardness of the diffusion layer while keeping the substrate hardness of 400 or more, it will be preferably used for sliding parts such as gears or bearings, and blades of electric shavers or hair clippers.

TABLE 1

| | Substrate Composition: wt % | Heat Treatment | | |
|---|---|---|---|---|
| | | Temp. (° C.) | Keeping Time | Cooling Rate (° C./sec) |
| Example 1 | Fe—13.5Cr—1.2Mo—0.4C | 1050 | 180 sec. | 60 |
| Example 2 | Fe—13.5Cr—1.2Mo—0.4C | 975 | 120 sec. | 15 |
| Example 3 | Fe—16.5Cr—0.9C—0.4Mo | 1000 | 30 sec. | 10 |

TABLE 1-continued

| | Substrate Composition: wt % | Heat Treatment Temp. (° C.) | Keeping Time | Cooling Rate (° C./sec) |
|---|---|---|---|---|
| Example 4 | Fe—12.5Cr—0.7C | 900 | 180 sec. | 30 |
| Example 5 | Fe—14Cr—1.1C | 1100 | 15 sec. | 20 |
| Example 6 | Fe—14Cr—1.0C | 1000 | 15 sec. | 10 |
| Example 7 | Fe—13.5Cr—1.2Mo—0.4C | 975 | 30 sec. | 15 |
| Example 8 | Fe—13.5Cr—1.2Mo—0.4C | 925 | 60 sec. | 30 |
| Example 9 | Fe—13.5Cr—1.2Mo—0.4C | 1100 | 90 sec. | 20 |
| Example 10 | Fe—18Cr—12Ni—0.1(C + N) | 550 | 2 hrs. | — |
| Example 11 | Fe—18Cr—12Ni—0.1(C + N) | 500 | 4 hrs. | — |
| Example 12 | Fe—18Cr—12Ni—0.05(C + N) | 600 | 2 hrs. | — |
| Example 13 | Fe—16Cr—4Ni—4Cu | 490 | 4 hrs. | — |
| Example 14 | Fe—17Cr—7Ni—1Al | 575 | 1.5 hrs. | — |
| Example 15 | Fe—17Cr—7Ni—1Al | 575 | 1.5 hrs. | — |
| Comparative Example 1 | Fe—13.5Cr—1.2Mo—0.4C | 1150 | 120 sec. | 20 |
| Comparative Example 2 | Fe—13.5Cr—1.2Mo—0.4C | 850 | 60 sec. | 30 |
| Comparative Example 3. | Fe—13.5Cr—1.2Mo—0.4C | 975 | 5 sec. | 15 |
| Comparative Example4 | Fe—13.5Cr—1.2Mo—0.4C | 975 | 240 sec. | 15 |
| Comparative Example 5 | Fe—13.5Cr—1.2Mo—0.4C | 975 | 30 sec. | 3 |
| Comparative Example 6 | Fe—14Cr—0.2C | 1100 | 150 sec. | 60 |
| Comparative Example 7 | Fe—9Cr—0.5C | 950 | 15 sec. | 10 |
| Comparative Example 8 | Fe—18Cr—12Ni—0.05(C + N) | 600 | 2 hrs. | — |
| Comparative Example 9 | Fe—18Cr—12Ni—0.05(C + N) | 600 | 0.3 hrs. | — |
| Comparative Examplc 10 | Fe—18Cr—12Ni—0.05(C + N) | 600 | 6 hrs. | — |
| Comparative Example 11 | Fe—18Cr—12Ni—0.05(C + N) | 650 | 2 hrs. | — |
| Comparative Example 12 | Fe—16Cr—4Ni—4Cu | 400 | 4 hrs. | — |

TABLE 2

| | Al—Fe Diffusion Layer Thick-ness (μm) | Hardness (Hv) | Al content (wt %) | Volume ratio (Vol %) | Peak ratio (%) | Substrate Hardness (Hv) |
|---|---|---|---|---|---|---|
| Example 1 | 45 | 900 | 45 | 97 | 40 | 600 |
| Example 2 | 20 | 1020 | 50 | 98 | 50 | 480 |
| Example 3 | 13 | 1000 | 47 | 98 | 55 | 500 |
| Example 4 | 8 | 1100 | 54 | 100 | 75 | 420 |
| Example 5 | 15 | 810 | 43 | 95 | 25 | 550 |
| Example 6 | 3 | 700 | 37 | 92 | 15 | 550 |
| Example 7 | 10 | 1140 | 62 | 100 | 90 | 500 |
| Example 8 | 5 | 1150 | 59 | 100 | 80 | 450 |
| Example 9 | 30 | 630 | 35 | 90 | 10 | 550 |
| Example 10 | 5 | 1100 | 55 | 100 | 70 | 550 |
| Example 11 | 3 | 1100 | 52 | 100 | 65 | 450 |
| Example 12 | 3 | 850 | 42 | 95 | 30 | 500 |
| Example 13 | 5 | 1150 | 60 | 100 | 80 | 400 |
| Example 14 | 6 | 1100 | 57 | 100 | 70 | 400 |
| Example 15 | 3 | 950 | 47 | 97 | 42 | 410 |
| Comparative Example 1 | 10 | 400 | 30 | 100 | 0 | 300 |
| Comparative Example 2 | 10 | 1200 | 65 | 95 | 95 | 350 |
| Comparative Example 3 | 10 | 350 | 80 | 85 | 0 | 350 |
| Comparative Example 4 | 10 | 450 | 30 | 100 | 0 | 400 |
| Comparative Example 5 | 10 | 1150 | 62 | 100 | 90 | 380 |

TABLE 2-continued

| | Al—Fe Diffusion Layer Thick-ness (μm) | Hardness (Hv) | Al content (wt %) | Volume ratio (Vol %) | Peak ratio (%) | Substrate Hardness (Hv) |
|---|---|---|---|---|---|---|
| Comparative Example 6 | 60 | 950 | 45 | 97 | 40 | 460 |
| Comparative Example 7 | 1 | — | — | — | — | 450 |
| Comparative Example 8 | 1 | — | — | — | — | 500 |
| Comparative Example 9 | 3 | 300 | 75 | 85 | 0 | 400 |
| Comparative Example 10 | 3 | 450 | 30 | 100 | 0 | 450 |
| Comparative Example 11 | 3 | 500 | 33 | 100 | 5 | 450 |
| Comparative Example 12 | 5 | 250 | 75 | 80 | 5 | 300 |

What is claimed is:

1. A ferrous alloy having a Fe—Al diffusion layer of improved hardness, said ferrous alloy comprising:

a substrate of Fe—Cr stainless steel having a Vickers hardness of 400 or more, said substrate comprises 73 to 89.9 wt % of Fe, 10 to 19 wt % Cr, 0.1 to 1.2 wt % of C, and less than 3 wt % of Ni;

said Fe—Al diffusion layer formed on a surface of said substrate;

wherein said Fe—Al diffusion layer has a thickness of 2 to 50 μm and comprises at least 90 vol % of an intermetallic compound of Al and Fe relative to a total volume of said diffusion layer; and wherein Al content included within a depth of at least 2 μm of said Fe—Al diffusion layer is 35 to 65% by weight based upon total weight of a region of said Fe—Al diffusion layer within the depth of at least 2 μm.

2. The ferrous alloy as set forth in claim 1, wherein said intermetallic compound contains at least one selected from the group consisting of $Al_2Fe$, $Al_{13}Fe_4$, $Al_3Fe$ and $Al_5Fe_2$.

3. The ferrous alloy as set forth in claim 2, wherein said diffusion layer includes said intermetallic compound at such an amount that said Fe—Al diffusion layer exhibits at least 10% of a peak ratio which is defined by 100×P1/(P1+P2) where P1 is a main peak height for said intermetallic compound and P2 is a main peak height for AlFe, and $AlFe_3$, said P1 and P2 being observed from an X-ray diffraction profile obtained through an X-ray diffraction at the outer surface of said diffusion layer.

4. The ferrous alloy as set forth in claim 1, wherein said Fe—Al diffusion layer has a thickness of 5 to 15 μm.

5. A ferrous alloy having a Fe—Al diffusion layer of improved hardness, said ferrous alloy comprising:

a substrate of Fe—Cr stainless steel having a Vickers hardness of 400 or more, said substrate comprises 66 to 81.9 wt % of Fe, 15 to 20 wt % of Cr, 3 to 13 wt % of Ni, and one element selected from 3 to 6 wt % of Cu, 0.5 to 2 wt % of Al, and 0.01 to 0.2 wt % of a total of C and N;

said Fe—Al diffusion layer formed on a surface of said substrate;

wherein said Fe—Al diffusion layer has a thickness of 2 to 50 μm and comprises at least 90 vol % of an intermetallic compound of Al and Fe relative to a total volume of said diffusion layer; and wherein Al content included within a depth of at least 2 μm of said Fe—Al diffusion layer is 35 to 65% by weight based upon total weight of a region of said Fe—Al diffusion layer within the depth of at least 2 μm.

6. A ferrous alloy having an Fe—Al diffusion layer for a cutting tool material, said ferrous alloy comprising:

a substrate of Fe—Cr stainless steel, said substrate comprising 73 to 89.9 wt % of Fe, 10 to 19 wt % of Cr, 0.1 to 1.2 wt % of C, and less than 3 wt % of Ni;

an Al layer formed on a surface of said substrate;

said Fe—Al diffusion layer formed by a heat treatment comprising heating said substrate having said Al surface layer thereon at a temperature of 900 to 1100° C. for 15 to 180 seconds, and then cooling said substrate from said temperature at a rate of at least 10° C. per second, said Fe—Al diffusion layer having a thickness of 2 to 50 μm and comprising at least 90 vol % of an intermetallic compound of Al and Fe relative to a total volume of said Fe—Al diffusion layer, and an Al content included within a depth of at least 2 μm of said Fe—Al diffusion layer being 35 to 65% by weight based upon total weight of a region of said Fe—Al diffusion layer within the depth of at least 2 μm;

wherein said heat treatment imparts a Vickers hardness of 400 or more to the substrate.

7. The ferrous alloy as set forth in claim 1, wherein said intermetallic compound contains at least one compound selected from the group consisting of $Al_2Fe$, $Al_{13}Fe_4$, and $Al_5Fe_2$.

8. The ferrous alloy as set forth in claim 7, wherein said diffusion layer includes said intermetallic compound at such an amount that said Fe—Al diffusion layer exhibits at least 10% of a peak ratio which is defined by 100×P1/(P1+P2) wherein P1 is a main peak height for said intermetallic compound and P2 is a main peak height for AlFe, and $AlFe_3$, said P1 and P2 being observed from an X-ray diffraction profile obtained through an X-ray diffraction at the outer surface of said diffusion layer.

9. The ferrous alloy as set forth in claim 6, wherein said Fe—Al diffusion layer has a thickness of 5 to 15 μm.

10. The ferrous alloy of claim 6, wherein the outer surface of said diffusion layer does not contain a layer of $Al_2O_3$.

11. A ferrous alloy having an Fe—Al diffusion layer for a cutting tool material, said ferrous alloy comprising:

a substrate of Fe—Cr stainless steel, said substrate comprising 66 to 81.9 wt % of Fe, 15 to 20 wt % of Cr, 3 to 13 wt % of Ni, and one element selected from: 3 to 6 wt % of Cu, 0.5 to 2 wt % of Al, and 0.01 to 0.2 wt % of a total of C and N;

an Al layer formed on a surface of said substrate;

said Fe—Al diffusion layer formed by a heat treatment of heating said substrate having said Al surface layer thereon at a temperature of 450 to 600° C. for 0.5 to 4 hours, said Fe—Al diffusion layer having a thickness of 2 to 50 μm and comprising at least 90 vol % of an intermetallic compound of Al and Fe relative to a total volume of said Fe—Al diffusion layer, and Al content included within a depth of at least 2 μm of said Fe—Al diffusion layer being 35 to 65% by weight based upon total weight of a region of said Fe—Al diffusion layer within the depth of at least 2 μm;

wherein said heat treatment imparts a Vickers hardness of 400 or more to said substrate.

12. The ferrous alloy as set forth in claim 11, wherein said intermetallic compound contains at least one selected from the group consisting of $Al_2Fe$, $Al_{13}Fe_4$, $Al_3Fe$ and $Al_5Fe$.

13. The ferrous alloy as set forth in claim 12, wherein said diffusion layer includes said intermetallic compound at such an amount that said Fe—Al diffusion layer exhibits at least 10% of a peak ratio which is defined by 100×P1/(P1+P2) wherein P1 is a main peak height for said intermetallic compound and P2 is a main peak height for AlFe, and $AlFe_3$, said P1 and P2 being observed from an X-ray diffraction profile obtained through an X-ray diffraction at the outer surface of said diffusion layer.

14. The ferrous alloy as set forth in claim 11, wherein said Fe—Al diffusion layer has a thickness of 5 to 15 μm.

15. The ferrous alloy of claim 11, wherein the outer surface of said diffusion layer does not contain a layer of $Al_2O_3$.

* * * * *

UNITED STATES PATENT AND TRADEMARK OFFICE

CERTIFICATE OF CORRECTION

PATENT NO. : 5,981,089
DATED : November 9, 1999
INVENTOR(S) : Junji IMAI et al.

It is certified that error appears in the above-identified patent and that said Letters Patent is hereby corrected as shown below:

On the title page,

Item [73] Assignee, please add after "Osaka, Japan", --Daido Tokushuko Kabushiki Kaisha, Aichi, Japan--.

Signed and Sealed this
Ninth Day of May, 2000

*Attest:*

Q. TODD DICKINSON

*Attesting Officer*

*Director of Patents and Trademarks*